US010392155B1

(12) United States Patent
Adams et al.

(10) Patent No.: US 10,392,155 B1
(45) Date of Patent: Aug. 27, 2019

(54) CONTAINER FOR USE IN ITEM SORTATION DEVICES AND SYSTEMS

(71) Applicant: Amazon Technologies, Inc., Seattle, WA (US)

(72) Inventors: Wesley Adams, Auburn, WA (US); Akshay Tilekar, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/002,565

(22) Filed: Jun. 7, 2018

(51) Int. Cl.

| | |
|---|---|
| ***B65D 5/46*** | (2006.01) |
| ***B31B 50/26*** | (2017.01) |
| ***B65D 5/468*** | (2006.01) |
| ***B65D 5/42*** | (2006.01) |
| ***B65D 5/66*** | (2006.01) |
| ***B65B 5/02*** | (2006.01) |
| ***B65D 5/10*** | (2006.01) |

(52) U.S. Cl.
CPC ..... *B65D 5/4608* (2013.01); *B31B 50/26* (2017.08); *B65B 5/024* (2013.01); *B65D 5/106* (2013.01); *B65D 5/4266* (2013.01); *B65D 5/6605* (2013.01)

(58) Field of Classification Search
CPC .... B65D 5/4608; B65D 5/106; B65D 5/4266; B65D 5/6605; B31B 50/26; B65B 5/024
USPC .... 229/103, 117.17, 117.13, 117.14, 117.15, 229/175, 176, 117.16
See application file for complete search history.

(56) References Cited

U.S. PATENT DOCUMENTS

| | | | | |
|---|---|---|---|---|
| 2,502,384 | A * | 3/1950 | Loth | B65D 5/48016 229/120.17 |
| 2,540,712 | A * | 2/1951 | Cassidy | B65D 5/48016 229/127 |
| 3,516,594 | A * | 6/1970 | Stenzel | B65D 5/2047 229/114 |
| 4,046,309 | A * | 9/1977 | Poggiali | B65D 5/02 229/117.17 |
| 5,673,847 | A * | 10/1997 | Swink | B65D 5/2009 229/113 |
| 9,540,132 | B1 * | 1/2017 | Lee | B65D 5/0245 |
| 2006/0163333 | A1 * | 7/2006 | Kornacki | B65D 5/001 229/104 |
| 2008/0237324 | A1 * | 10/2008 | Walling | B65D 5/0227 229/117.17 |
| 2009/0173773 | A1 * | 7/2009 | Blin | B65D 5/443 229/117.16 |

(Continued)

*Primary Examiner* — Christopher R Demeree
(74) *Attorney, Agent, or Firm* — BakerHostetler

(57) ABSTRACT

A method of preparing a container includes manipulating it from an open toward a fully closed configuration. In the open configuration, first and second top end flaps are folded outwardly such that a first pair of handle apertures defined in a first endwall and first top end flap are aligned and a second pair of handle apertures defined in the second endwall and second top end flap are aligned along a first direction. The manipulating step comprises: folding top side flaps inwardly along a second direction until the side flaps are substantially perpendicular to the endwalls, thereby at least partially covering a top opening of the container; and folding the end flaps inwardly until they are substantially parallel with the side flaps, wherein the top side flaps underlie the respective ones of the pairs of handle apertures that are defined in the first and second top end flaps.

20 Claims, 6 Drawing Sheets

(56) References Cited

U.S. PATENT DOCUMENTS

2016/0052676 A1* 2/2016 Holley, Jr. ..... B65D 71/36
229/117.16

* cited by examiner

CONTAINER FOR USE IN ITEM SORTATION DEVICES AND SYSTEMS

BACKGROUND

In a materials handling facility, such as an order fulfilment center, multiple customer orders are received, where each order specifies one or more items from inventory to be shipped to the customer that submitted the order. To fulfill the customer orders, the one or more items specified in each order may be retrieved, or picked, from inventory (which may also be referred to as stock storage) in the materials handling facility. Under direction of a control system, picked items may be singulated and then inducted into a conveyance mechanism that routes the items to particular destinations, such as sorting stations, in accordance with the customer orders currently being processed. Such sorting stations can employ an automated or semi-automated item sortation apparatus that aggregates items associated with a customer order into one or more bins.

BRIEF DESCRIPTION OF THE DRAWINGS

The following detailed description will be better understood when read in conjunction with the appended drawings, in which there is shown in the drawings example embodiments for the purposes of illustration. It should be understood, however, that the present disclosure is not limited to the precise arrangements and instrumentalities shown. In the drawings.

DETAILED DESCRIPTION

The present disclosure pertains to containers 2 that can be employed, in one example, as output bins in an item sortation apparatus, such as the apparatus more fully described in International Patent Publication No. WO 2018/031956, published on Feb. 15, 2018, in the name of Garrett et al. (referred to herein as the "Garrett Reference"), the entire disclosure of which is incorporated herein by this reference. The containers 2 are designed for substantially quick assembly from an initial, flat die-cut configuration into an open configuration for induction of items therein and further into a fully closed configuration for conveyance from the sortation apparatus at least to a staging location within the fulfillment center. The container 2 has endwalls and sidewalls. The container 2 also has top end flaps connected to the endwalls and top side flaps connected to the sidewalls. The endwalls have handle apertures therein, and the top end flaps also have handle apertures therein. When the container 2 is in the open configuration and the top end flaps are folded outwardly and doubled over the endwalls, the handle apertures in the top end flaps are aligned with the handle apertures in the endwalls. When the container 2 is in the fully closed configuration, the handle apertures in the top end flaps are overlapped underneath by the top side flaps to support the top end flaps. Thus, the handle apertures render the containers 2 more versatile and simpler to manipulate in an item sortation apparatus.

Figure 1:
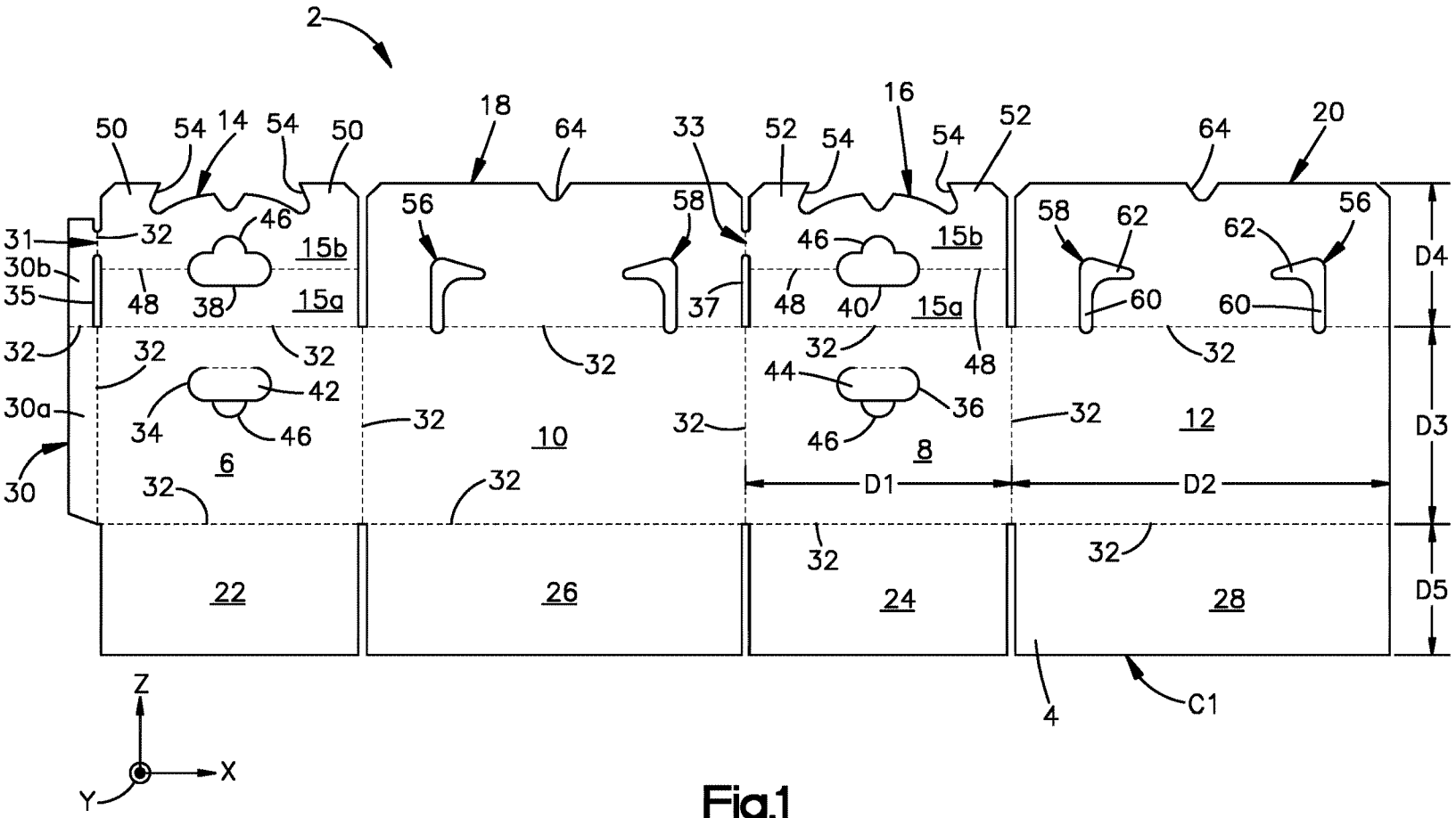
FIG. 1 shows a plan view of a container in an initial configuration, according to an embodiment of the present disclosure.

Referring now to FIG. 1, a container 2 (also referred to herein as a "box") can comprise a single piece of packaging material 4 having an initial configuration C1 that is substantially planar or "flat". The shape of the container 2 in its initial configuration C1 can be defined via a die cutting process. Thus, the initial configuration C1 or shape of the container 2 can be referred to as its "die-cut" configuration and shape, respectively. The container 2 can comprise any material suitable for packing items therein, including cardboard (such as corrugated fiberboard, also referred to as "corrugated board"), paperboard, other paper-based board materials, or one or more plastic materials, by way of non-limiting examples.

Figure 3:
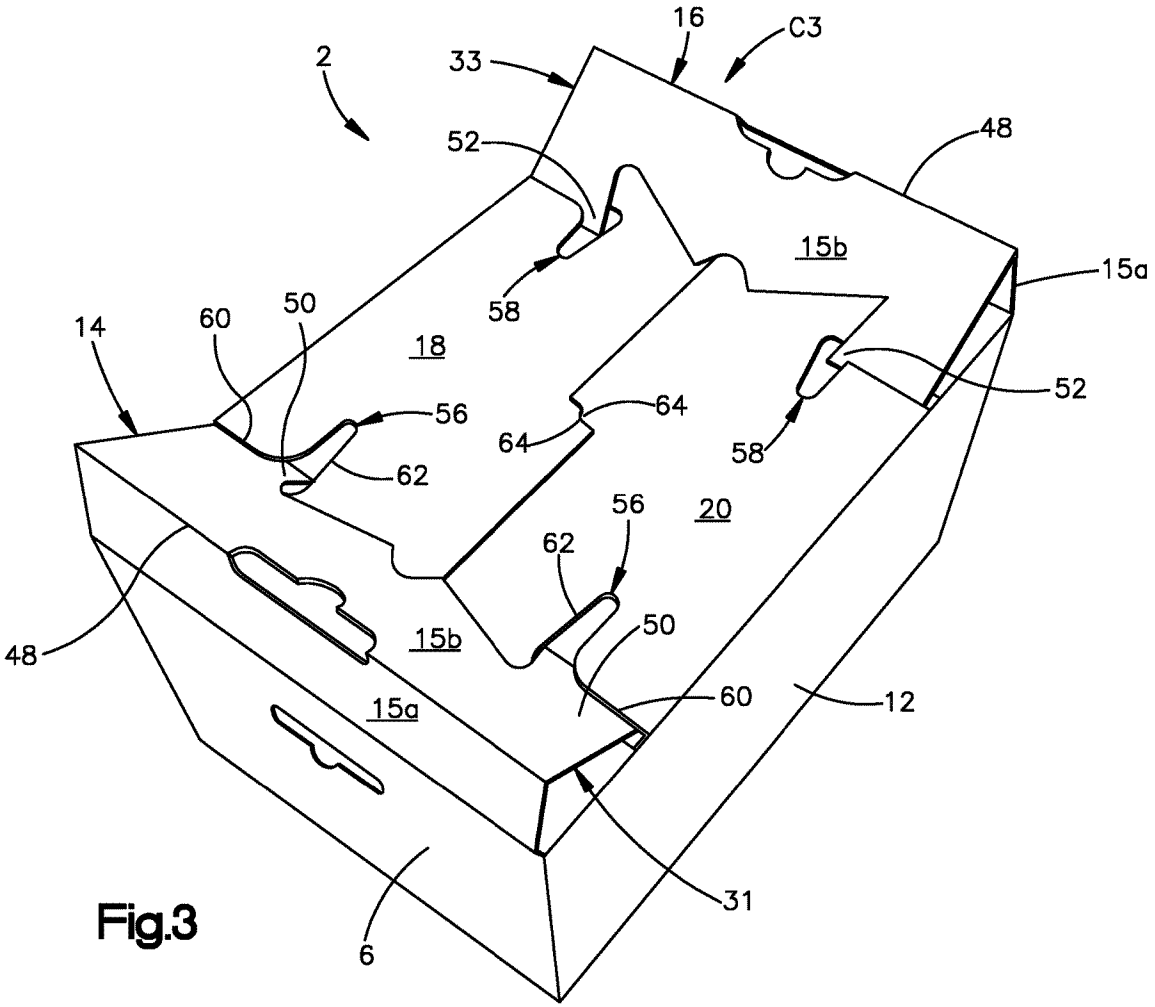
FIG. 3 shows a perspective view of the container of FIG. 1 in a partially closed configuration, according to an embodiment of the present disclosure.
Figure 4:
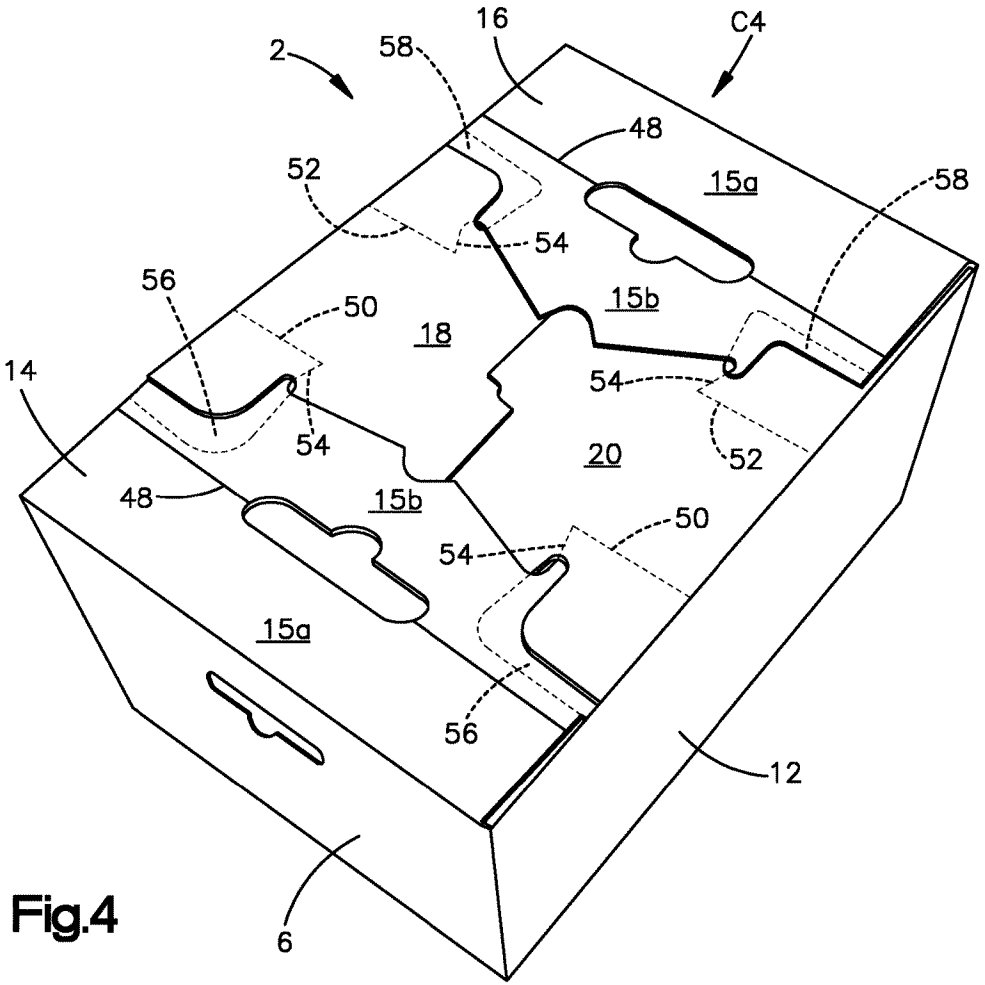
FIG. 4 shows a perspective view of the container of FIG. 2 is a closed configuration, according to an embodiment of the present disclosure.

The container 2 is foldable from the initial configuration C1 into an open configuration C2 (FIG. 2) for receiving one or more items therein. Thus, the open configuration C2 can also be characterized as an "induction configuration". The container 2 is further foldable from the open configuration C2 into a partially closed configuration C3 (FIG. 3) and thereafter into a fully closed configuration C4 (FIG. 4). The fully closed configuration C4 is preferable for conveying the container 2 bearing the one or more items to another location, as described in more detail below. In the fully closed configuration C4, the container 2 preferably defines a cuboid shape, although other geometries are possible. The open configuration C2 can also be referred to as a "first intermediate configuration". The partially closed configuration C3 can also be referred to as a "second intermediate configuration".

With continued reference to the initial configuration C1 as shown in FIG. 1, the container 2 can include a first endwall panel 6 and a second endwall panel 8 opposite each other. The container 2 can also include a first sidewall panel 10 and a second sidewall panel 12 opposite each other. The first and second endwall panels 6, 8 and the first and second sidewall panels 10, 12 are also referred to herein as the first and second "endwalls" 6, 8 and the first and second "sidewalls" 10, 12, respectively. The first and second endwalls 6, 8 can be referred to collectively as a "pair of endwalls". Additionally, the first and second sidewalls 10, 12 can be referred to collectively as a "pair of sidewalls".

In the initial configuration C1, the endwalls 6, 8 and the sidewalls 10, 12 are each preferably aligned along a first direction X. In the initial configuration C1, the single piece of material 4 has a thickness in a second direction Y that is substantially perpendicular to the longitudinal direction X. The container 2 includes a first top end flap 14 extending from the first endwall 6 and a second top end flap 16 extending from the second endwall 8. The container 2 includes a first top side flap 18 that extends from the first sidewall 10 and a second top side flap 20 that extends from the second sidewall 12. A first bottom end flap 22 extends from the first endwall 6 and is located opposite the first top end flap 14 along a third direction Z that is substantially perpendicular to the first and second directions X, Y. A second bottom end flap 24 extends from the second endwall 8 and is located opposite the second top end flap 16 along the third direction Z. A first bottom side flap 26 extends from the first sidewall 10 and is located opposite the first top side flap 18 along the third direction Z. A second bottom side flap 28 extends from the second sidewall 12 and is located opposite the second top side flap 20 along the third direction Z.

The container 2 can also include a connecting tab 30 extending from one or both of the first endwall 6 and the first top end flap 14 along the first direction X. In the present embodiment, the connecting tab 30 includes a first portion 30*a* that extends from the first endwall 6 and a second portion 30*b* that extends from the first top end flap 14. The container 2 preferably defines pre-formed crease lines, such as scoring or score lines 32, which facilitate folding of the container 2 into the intermediate and closed configurations.

The container 2 can include one or more locking features configured to retain various portions of the container 2 into desired positions with respect to each other in the intermediate and closed configurations. For example, the container 2 can include a first locking element configured to couple one of the top end flaps 14, 16 to one of the top side flaps 18, 20. The container 2 can also include a second locking element configured to couple the other of the top end flaps 14, 16 to the other of the top side flaps 18, 20. In the illustrated embodiment, the first locking element can comprise a first frangible portion 31 joining the connecting tab 30 to the first top end flap 14. The first frangible portion 31 can be at least partially defined by one or more cutouts 35 in the container 2 between the connecting tab 30 and the first top end flap 14. The second locking element can comprise a second frangible portion 33 joining the first top side flap 18 to the second top end flap 16. The second frangible portion 31 can be at least partially defined by one or more cutouts 35 in the container 2 between the connecting tab 30 and the first top end flap 14. The function of the first and second frangible portions 31, 33 is discussed in more detail below.

The first endwall 6 defines a first handle aperture 34. The second endwall 8 defines a second handle aperture 36. The first top end flap 14 defines a third handle aperture 38. The second top end flap 16 defines a fourth handle aperture 40. In the initial configuration C1, the first and second handle apertures 34, 36 are aligned with one another along the first direction X and the third and fourth handle apertures 38, 40 are aligned with one another along the first direction X. Additionally, in the initial configuration C1, the first and third handle apertures 34, 38 are aligned with one another along the third direction Z and the second and fourth handle apertures 36, 40 are aligned with one another along the third direction Z. The foregoing alignments allow the first and third handle apertures 34, 38 to be aligned with each other and allow the second and fourth handle apertures 36, 40 to be aligned with each other when the container 2 is in the intermediate configuration. Thus, the first and third handle apertures 34, 38 can be characterized as a "first pair of handle apertures" and the second and fourth handle apertures 36, 40 can be characterized as a "second pair of handle apertures". The handle apertures 34, 36, 38, 40 are discussed in more detail below.

The container 2 can include a first hinge tab 42 associated with one of the first and third handle apertures 34, 38 and a second hinge tab 44 associated with one of the second and fourth handle apertures 36, 40. For example, in the initial configuration C1, the first hinge tab 42 can occupy at least a portion of the first handle aperture 34 and the second hinge tab 44 can occupy at least a portion of the second handle aperture 36. Alternatively, the first and second hinge tabs 42, 44 can occupy at least portions of the third and fourth handle apertures 38, 40 in the initial configuration C1. The first, second, third, and fourth handle apertures 34, 36, 38, 40 can each also include a notch 46 sized to receive a finger of an operator for deflecting the respective first and second hinge tabs 42, 44 as needed.

With continued reference to FIG. 1, the first and second top end flaps 14, 16 can each define a first portion 15*a* adjacent the associated endwall 6, 8 and a second portion 15*b* remote from the associated endwall 6, 8. The first and second top end flaps 14, 16 can also include a pre-defined crease line 48 that defines a boundary between the first and second portions 15*a*, 15*b*. The crease lines 48 preferably intersect the third and fourth handle apertures 38, 40. The crease lines 48 are configured to allow the second portion 15*b* to fold or otherwise bend with respect to the first portion 15*a* in a predictable manner. The crease lines 48 are preferably defined by bend-enhancing features, such as scoring and/or perforations, for example. In other embodiments, however, the crease lines 48 can be devoid of scoring and/or perforations and can instead be substantially pre-defined by the respective geometries of the top end flaps 14, 16 and the third and fourth handle apertures 38, 40. For example, the third and fourth handle apertures 38, 40 can be sized and shaped so as to effectively weaken the top end flaps 14, 16 against bending so as to induce bending about respective creases that form substantially along lines 48 that intersect the handle apertures 38, 40 at the side apices thereof.

The first top end flap 14 can define at least one first protrusion 50 and the second top end flap 16 can define at least one second protrusion 52. In the illustrated embodiment, the at least one first protrusion 50 comprises a first pair of protrusions 50 and the at least one second protrusion 52 comprises a second pair of protrusions 52. The protrusions of each pair of protrusions 50, 52 can define inner edges 54 that taper toward one another.

The first and second top side flaps 18, 20 can collectively define at least one first receiving aperture 56 and at least one second receiving aperture 58. In the illustrated embodiment, the at least one first receiving aperture 56 is a first pair of receiving apertures 56 and the at least one second receiving aperture 58 is a second pair of receiving apertures 58. Moreover, in the illustrated embodiment, the first top side flap 18 defines one of the first pair of receiving apertures 56 and one of the second pair of receiving apertures 58, while the second top side flap 20 defines the other of the first pair of receiving apertures 56 and the other of the second pair of receiving apertures 58. Each of the receiving apertures 56, 58 can be substantially L-shaped and can include a base portion 60 and an extension portion 62 that is oriented substantially perpendicular to the base portion 60.

In embodiments where the container 2 is configured to define a cuboid shape in the fully closed configuration C4, such as in the depicted embodiment, the first and second endwalls 6, 8 can each define a first dimension D1 and the first and second sidewalls 10, 12 can each define a second dimension D2. In the initial configuration C1, the first and second dimensions D1, D2 are each measured along the first direction X. The first and second endwalls 6, 8 and the first and second sidewalls 10, 12 can each define a third dimension D3 that is measured along the third direction Z when the container 2 is in the initial configuration C1. The first and second top side flaps 18, 20 can each define a fourth dimension D4 that is measured along the third direction Z when the container 2 is in the initial configuration C1. The first and second bottom side flaps 26, 28 can each define a fifth dimension D5 that is measured along the third direction Z when the container 2 is in the initial configuration C1.

The first and second top side flaps 18, 20 can optionally define a pair of notches 64 that have corresponding geometries. For example, the notches 64 can each substantially define a V-shape, although other geometries are within the scope of the present disclosure. The function of the notches 64 is discussed in more detail below.

Figure 2:
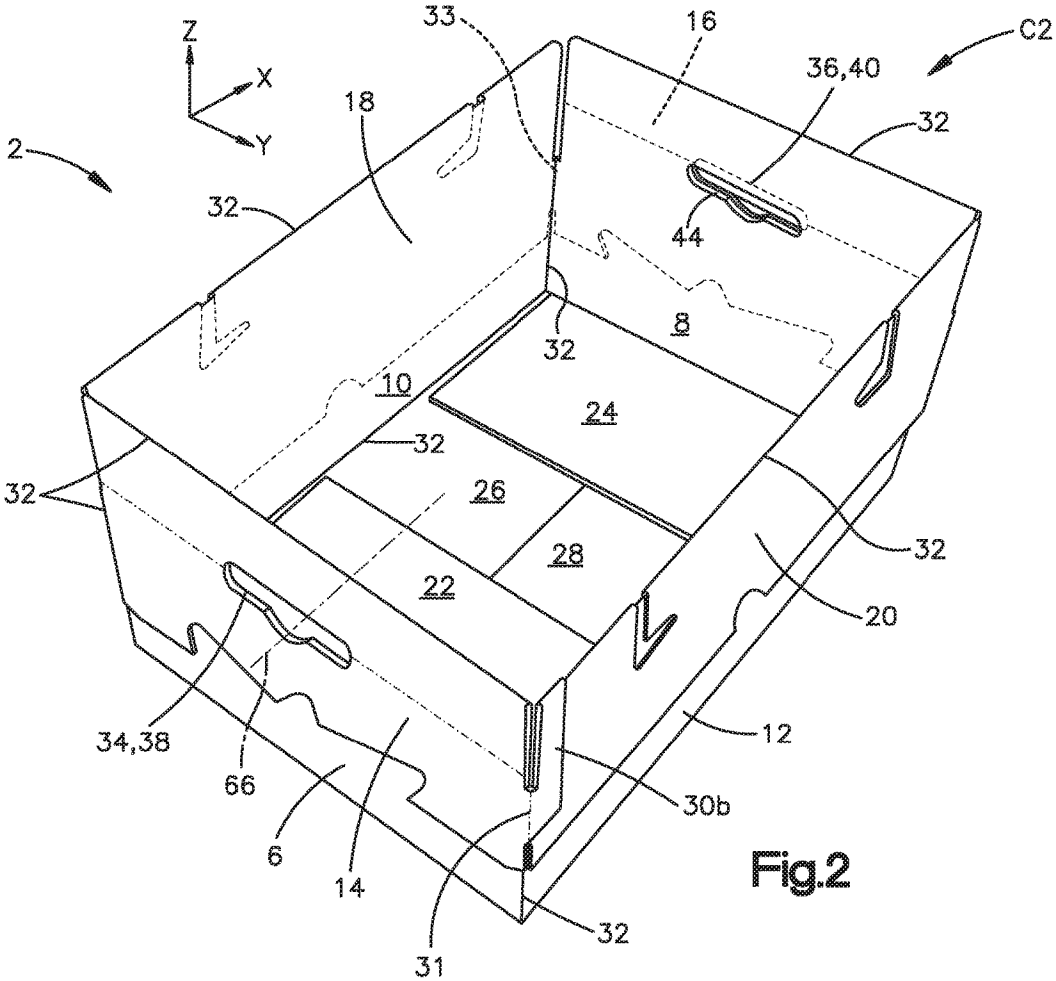
FIG. 2 shows a perspective view of the container of FIG. 1 in an open configuration, according to an embodiment of the present disclosure.

With reference to FIG. 2, the open configuration C2 of the container 2 will now be discussed. When the container 2 is in the open configuration C2, the first and second endwalls 6, 8 are preferably folded so as to be opposite and facing each other along the first direction X, while the first and second sidewalls 10, 12 are preferably folded so as to be opposite and facing each other along the second direction Y. Thus, when the container is in the open configuration C2 (and also in the partially and fully closed configurations C3, C4 as shown in FIGS. 3 and 4): the first dimension D1 can be characterized as the "width" of the container 2 and can be oriented along the second direction Y; the second dimension D2 can be characterized as the "length" of the container 2 and can remain oriented along the first direction X; and the third dimension D3 can be characterized as the "height" of the container 2 and can remain oriented along the third direction Z. The length D2 and the width D1 can be unequal. For example, as shown, the length D2 can be greater than the width D1. In other embodiments, the width D1 can be greater than the length D2. In yet other embodiments, the length D2 and the width D1 can be substantially equivalent. Preferably, the height D3 of the container 2 is less than each of the length D2 and the width D1 so as to reduce the likelihood that the container 2 tips onto one of its endwalls 6, 8 or sidewalls 10, 12 after induction of one or more items therein, such as during subsequent conveyance of the container 2.

In the open configuration C2, the connecting tab 30 can be affixed to an inner surface of the second sidewall 12, thereby affixing the first endwall 6 to the second sidewall 12. The connecting tab 30 can be affixed to the inner surface of the second sidewall 12 by an adhesive, such as one or more adhesive strips, and/or a liquid-based adhesive, such as a glue, by way of non-limiting examples.

In the open configuration C2, the first and second bottom end flaps 22, 24 are folded with respect to the first and second endwalls 6, 8 about their respectively shared score lines 32 so as to be substantially perpendicular to the endwalls 6, 8 and sidewalls 10, 12. In the open configuration C2, the first and second bottom side flaps 26, 28 are folded with respect to the first and second sidewalls 10, 12 about their respectively shared score lines 32 so as to be substantially perpendicular to the sidewalls 10, 12 and endwalls 6, 8. In the open configuration C2, the bottom end flaps 22, 24 and the bottom side flaps 26, 28 define a bottom of the container 2. As shown, the bottom end flaps 22, 24 can overlay the bottom side flaps 26, 28. In such embodiments, the fifth dimension D5 of each bottom side flap 26, 28 is preferably substantially one half of the width D1 so that the edges of the bottom side flaps 26 substantially meet in the center of the bottom of the container 2. The edges of the bottom side flaps 26 can be affixed together, such as by an adhesive, such as tape, or by another suitable fixation mechanism.

With continued reference to the open configuration C2, the first and second top end flaps 14, 16 are folded with respect to the first and second endwalls 6, 8 about their respectively shared score lines 32 so as to be doubled over, and parallel with, the first and second endwalls 6, 8, respectively. The top end flaps 14, 16 and the top side flaps 18, 20 can optionally be locked in their doubled over positions via the first and second locking elements. For example, as shown in the illustrated embodiments, the first top end flap 14 remains coupled to the second top side flap 20 via the first frangible portion 31, while the second top end flap 16 remains coupled to first top side flap 18 via the second frangible portion 32. The first and second frangible portions 31, 33, in combination with the respective orientations of the top end flaps 14, 16 and the top side flaps 18, 20, collectively retain the top end and side flaps 14, 16, 18, 20 in their double over positions. Thus, in such embodiments, the open configuration C2 can also be characterized as a "locked open" configuration.

In the open configuration C2, each of the handle apertures 34, 36, 38, 40 is elongate along the second direction Y. Moreover, in the open configuration C2, the first and third handle apertures 34, 38 are aligned with each other along the first direction X and the second and fourth handle apertures 36, 40 are aligned with each along the first direction X. Stated differently, a single axis 66 can extend through each of the handle apertures 34, 36, 38, 40 when the container 2 is in the open configuration C2. In this manner, an operator can grip the container 2 with one hand purchased within the first and third handle apertures 34, 38 and the other hand purchased within the second and fourth handle apertures 36, 40. Preferably, each of the handle apertures 34, 36, 38, 40 is sized so that the operator can insert at least four (4) fingers therein. Additionally, the first and second hinge tabs 42, 44 can be folded so as to vacate one or both of their respective handle apertures to allow the operator to insert their fingers therein as needed. Moreover, the hinge tabs 42, 44 can be folded inwardly toward an interior of the container 2 so as to provide at least the first and second handle apertures 34, 36 with additional surface area to be gripped the operators hands.

With reference to FIG. 3, the partially closed configuration C3 of the container 2 will now be discussed. To manipulate the container 2 into the partially closed configuration C3, the first and second frangible portions 31, 33 can be broken. Subsequently, the first and second top side flaps 18, 20 are folded with respect to the first and second sidewalls 10, 12 about their respectively shared score lines 32 so as to be doubled over, and parallel with, the first and second sidewalls 10, 12. In the present embodiment, in the partially closed configuration C3, the base portions 60 of the receiving apertures 58 are elongate substantially along the second direction Y and the extension portions 62 are elongate substantially along the first direction X.

The top side flaps 18, 20 can be sized such that they overlap one another along the second direction Y in the partially closed configuration C3 (and in the fully closed configuration C4). Thus, in such embodiments, the fourth dimension D4 of each top side flap 18, 20 is greater than one half of the width D1 of the container 2. Moreover, the V-shaped notches 64 can interlock with one another so as to interlock the top side flaps 18, 20 together. In this manner, the top side flaps 18, 20 can overlap each other along the second direction Y. In other embodiments, other interlocking features can be employed instead of the corresponding notches 64 so as to allow the top side flaps 18, 20 to overlap one another. In yet other embodiments, however, the top side flaps 18, 20 need not overlap each other in the partially closed or fully closed configurations C3, C4. In such embodiments, other fixation means can optionally be employed to affix the top side flaps 18, 20 together, such as tape or other adhesives, for example.

In the partially closed configuration C3, the first portions 15*a* of the top end flaps 14, 16 are folded with respect to the first and second endwalls 6, 8 about their respectively shared score lines 32 so as to extend upward from the endwalls 6, 8. The second portions 15*b* of the top end flaps 14, 16 are folded with respect to the first portions 15*a* about their respective crease lines 48. In this manner, the second portions 15*b* of the top end flaps 14, 16 can extend dowwardly from their respective crease lines 48 toward the top side flaps 18, 20. Thus, the first pair of protrusions 50 can enter the base portions 60 of the first pair of receiving apertures 56, and the second pair of protrusions 52 can enter the base portions 60 of the second pair of receiving apertures 58.

With reference to FIG. 4, the fully closed configuration C4 of the container 2 will now be discussed. To manipulate the container 2 from the partially closed configuration C3 to the fully closed configuration C4, the first and second pairs of protrusions 50, 52 can be advanced along the extension portions 62 of the first and second pairs of receiving apertures 56, 58 along the first direction X. As the first and second pairs of protrusions 50, 52 thus advance, the first and second portions 15*a*, 15*b* of the top end flaps 14, 16 become substantially planar with one another. In the fully closed configuration C4, the first and second portions 15*a*, 15*b* of the top end flaps 14, 16 are substantially perpendicular with the endwalls 6, 8 and the sidewalls 10, 12. Additionally, the first and second pairs of protrusions 50, 52 extend within the first and second pairs of receiving apertures 56, 58. Moreover, the tapered inner edges 54 of the pairs of protrusions 50, 52 can underlie respective portions of the top side flaps 18, 20 that are adjacent the receiving apertures 56, 58. The foregoing engagements between the pairs of protrusions 50, 52 and the pairs of receiving apertures 56, 58 interlock the top end flaps 14, 16 with the top side flaps 18, 20 in the fully closed configuration C4. Additionally, in the fully closed configuration C4, the top side flaps 18, 20 underlie (i.e., overlap underneath) the third and fourth handle apertures 38, 40 in the top end flaps 14, 16 to provide support beneath the third and fourth handle apertures 38, 40 as well as the beneath the top end flaps 14, 16.

It is to be appreciated that, once interlocked, the top end flaps 14, 16 and the top side flaps 18, 20 are retained in the fully closed configuration C4 by friction. Thus, the interlocked top flaps 14, 16, 18, 20 can be employed in lieu of tape or other adhesives to retain the top of the container 2 in the fully closed configuration C4. Additionally, the interlocked top flaps 14, 16, 18, 20 can advantageously reduce the likelihood that they become inadvertently opened, such as when the container 2 is subsequently conveyed, or even should the container 2 become inadvertently tipped upside-down or onto one of its sidewalls 10, 12 or endwalls 6, 8, for example. Furthermore, in the fully closed configuration C4, the interlocked top flaps 14, 16, 18, 20 support and reinforce one another against top loads, such as the weight of a column of additional filled and closed containers stacked atop the container 2, for example. Thus, the present design enhances the stacking capabilities of the container 2.

It is to be appreciated that in additional embodiments the bottom flaps 22, 24, 26, 28 of the container can be configured so as to interlock with one another in a manner similar to that described above with reference to the top flaps 14, 16, 18, 20. In such embodiments, the interlocking bottom flaps 22, 24, 26, 28 can be employed in lieu of tape or other adhesives to retain the bottom of the container 2 in a closed configuration. In such embodiments, the bottom side flaps 26, 28 preferably overlap one another in the second direction Y and include corresponding interlocking notches, similar to the notches 64 or other interlocking features described above.

Figure 5:
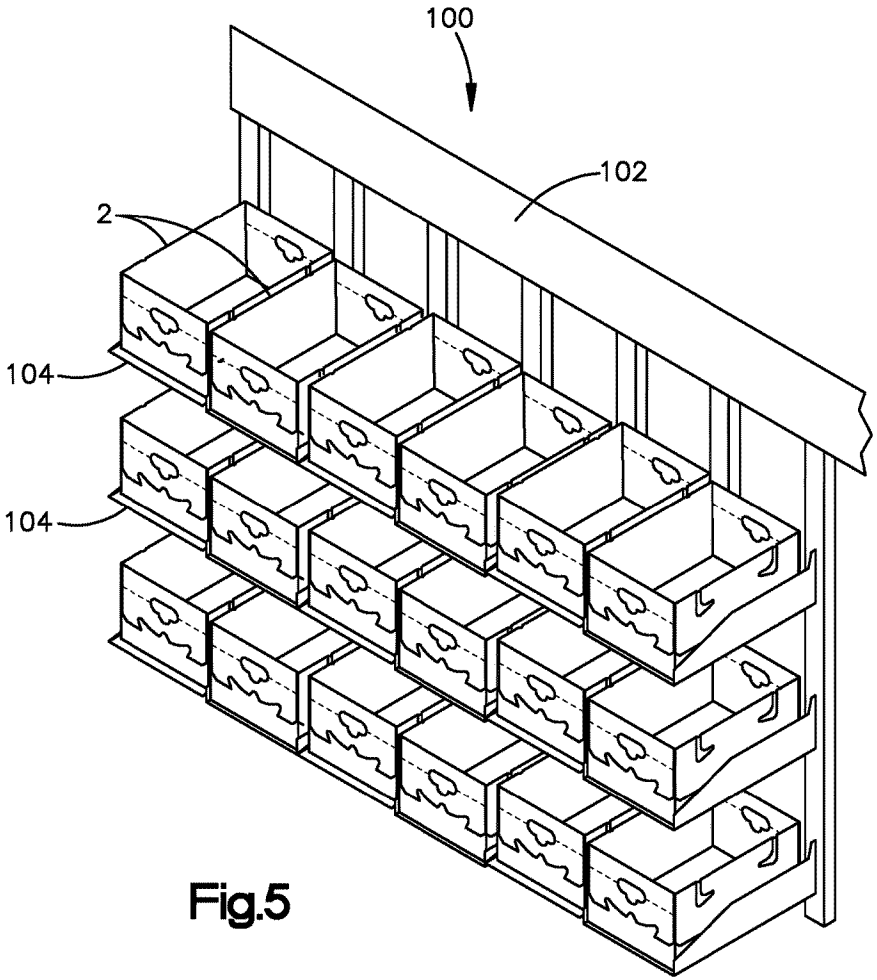
FIG. 5 shows a front elevation view of a portion of an item sortation apparatus that employs the containers shown in FIGS. 1 through 4, according to an embodiment of the present disclosure.

Referring now to FIG. 5, the containers 2 described above can be employed in an item sortation apparatus 100 of a material handling system. The apparatus 100 can include a frame 102 carrying a plurality of receptacles 104 for respectively holding a plurality of containers 2, such as those described above with reference to FIGS. 1 through 4. The receptacles 104 can be arranged into one or more columns and one or more rows. The apparatus 100 can include a track system and one or more shuttles that travel thereon to deliver items to the various containers 2. The items can be loaded onto the one or more shuttles at a loading station. The apparatus 100 can also include an induction station that serially feeds items to the loading station. The apparatus 100 can be configured similar to the item sortation apparatus more fully described in the Garrett Reference discussed above.

When all of the items associated with an order fulfillment shipment (which can range from a subset of a single customer order, including as few as a single item, to a plurality of customer orders) have been aggregated into a container 2, an operator can remove the container 2 and replace it with an empty one in an open configuration. The removed container 2 can then be folded into a partially and then fully closed configuration C4 as described above with reference to FIGS. 3 and 4. Subsequently, the fully closed container 2 can be deposited on a mechanical conveyor for delivery to another portion of the fulfillment center, such as to one of a plurality of staging locations associated with a predetermined zip code, for example. At the staging locations, the containers 2 can optionally be palletized and loaded onto a delivery vehicle, such as a truck. The containers 2 described herein are configured to remain in the fully closed configuration through the duration of mechanical conveyance, including along conveyor belts, spur conveyors, rotory conveyors, kick-off chutes, and the like, which can expose the container 2 to vibrations, impacts, and sudden changes in momentum (such as around turns), for example. Additionally, as described above, particularly with respect to embodiments where the top flaps 14, 16, 18, 20 are interlocked in the fully closed configuration C4, the containers 2 are configured to maintain their shape when supporting a vertical column of additional containers 2 therein, such as in a stack of containers 2 loaded onto a delivery truck, for example.

Figure 6:
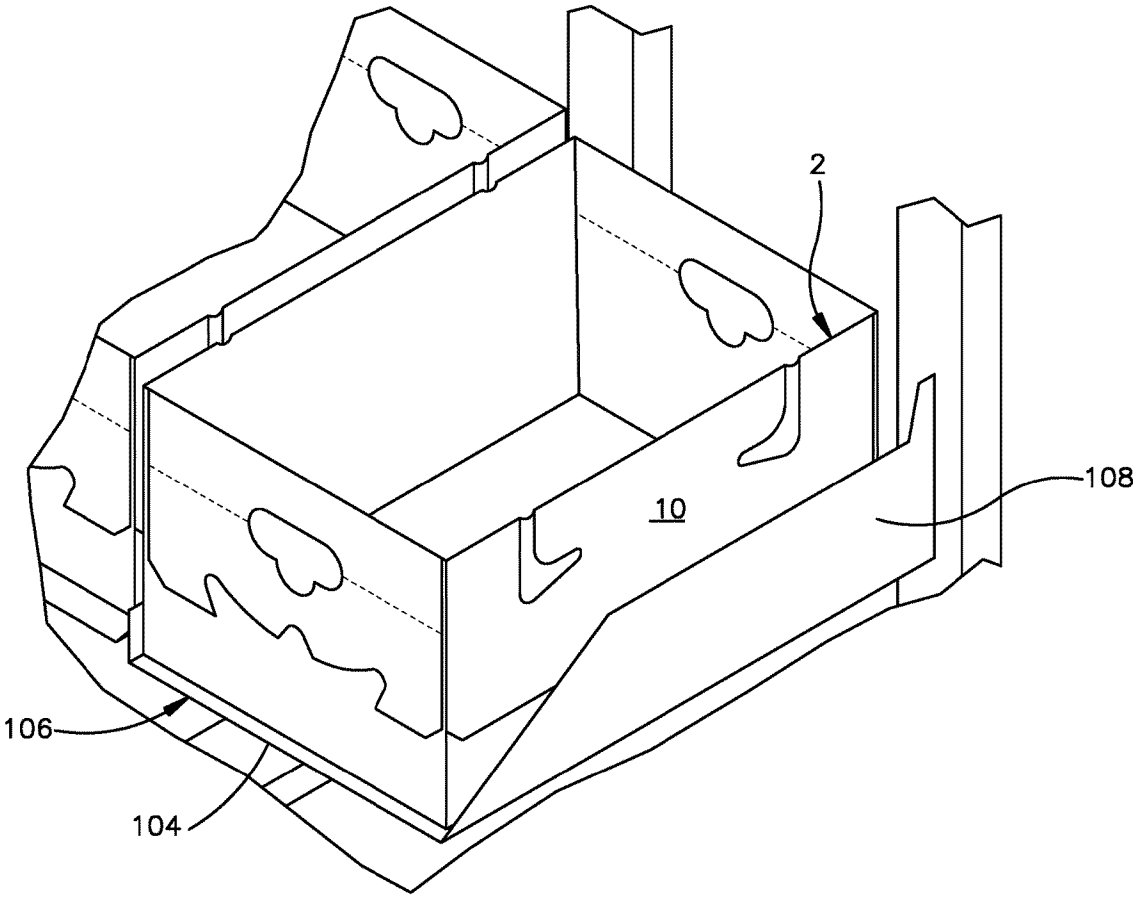
FIG. 6 shows a perspective view of a portion of the item sortation apparatus of FIG. 5, showing a receptacle carrying a container, according to an embodiment of the present disclosure.

As shown in FIG. 6, one or more of the receptacles 104 can define optionally define a substantially open front end 106 and a pair of sidewalls 108. The receptacles 104 are sized so that containers 2, having been reconfigured from their initial configurations into open configurations, can be inserted into and subsequently removed from respective ones of the receptacles 104 through the front ends 106 thereof. A container 2 that is in a locked open configuration (see FIG. 2) can be inserted with ease through the open front end 106. The receptacle sidewalls 108 can define a height that is no less than about one half of the height D3 of the container 2. In this manner, even if a container 2 is in an open but unlocked configuration (such as if one or both of the frangible portions 31, 33 is broken or omitted), an operator can insert the container 2 into a receptacle 104 by folding or otherwise holding down top side flaps 18, 20 downward until they fit between the receptacle sidewalls 108, which will then retain the top side flaps 18, 20 while the operator then simply pushes the container 2 into a fully seated position in the receptacle 104. The receptacle sidewalls 108 can also taper upwardly and toward the rear of the receptacle 104 to further facilitate insertion of the container 2 therein from the front end 106.

It is to be appreciated that the containers 2 described herein can be employed for various uses. For example, the containers 2 can be employed as a shipping package for one or more items of a single customer order (or a subset of a single customer order). In other embodiments, the containers 2 can be employed as bins or totes for delivering one or more previously packaged items to a staging location within the fulfillment center. Other uses for the containers 2 are within the scope of the present disclosure. Moreover, the dimensions (including the thickness of the die-cut single piece of material 4) of the container 2 can be adjusted and scaled as needed.

Additional non-limiting example embodiments of the present disclosure are set forth below.

Embodiment 1

A box for containing one or more items, the box being foldable from a substantially flat initial configuration into an open, intermediate configuration and further into a fully closed configuration. The box comprises: first and second sidewalls opposite one another; first and second endwalls opposite one another, the first endwall defining a first handle aperture, the second endwall defining a second handle aperture; first and second top end flaps extending respectively from the first and second endwalls, the first top end flap defining a third handle aperture, the second top end flap defining a fourth handle aperture; first and second top side flaps extending respectively from the first and second sidewalls, wherein, in the intermediate configuration, 1) the first and second top end flaps are folded so as to be doubled over, and parallel with, the first and second endwalls, respectively, 2) the first and third handle apertures are aligned with each other along a first direction so as to be gripped by a hand, and 3) the second and fourth handle apertures are aligned with each along the first direction so as to be gripped by another hand, and wherein, in the fully closed configuration, 1) the first and second top end flaps are folded so as to be substantially perpendicular to the first and second endwalls, respectively, 2) the first and second top side flaps are folded so as to be substantially perpendicular to the first and second sidewalls, respectively, and to underlie both of the third and fourth handle apertures, and 3) the first and second top end flaps and the first and second top side flaps collectively interlock with each other.

Embodiment 2

The box of Embodiment 1, further comprising: a pair of bottom end flaps extending respectively from the first and second endwalls opposite the first and second top end flaps; and a pair of bottom side flaps extending respectively from the first and second sidewalls opposite the first and second top side flaps, wherein, in both of the intermediate and fully closed configurations, 1) the first and second bottom side flaps are folded so as to be substantially perpendicular to the first and second sidewalls, respectively, and 2) the first and second bottom end flaps are folded so as to be substantially perpendicular to the first and second endwalls.

Embodiment 3

The box of Embodiment 1 or Embodiment 2, further comprising: a first hinge tab located within one of the first and third handle apertures when the box is in the initial configuration, wherein the first hinge tab is foldable so as to vacate the one of the first and third handle apertures; a second hinge tab located within one of the second and third handle apertures when the box is in the initial configuration, wherein the second hinge tab is foldable so as to vacate the one of the second and fourth handle apertures.

Embodiment 4

The box of any one of Embodiments 1 through 3, wherein the first top end flap defines a first pair of protrusions, the second top end flap defines a second pair of protrusions, the first and second top side flaps collectively define a first pair of receiving apertures, and the first and second top side flaps collectively define a second pair of receiving apertures.

Embodiment 5

The box of Embodiment 4, wherein, in the fully closed configuration, the pair of protrusions of the first top end flap and the pair of protrusions of the second top end flaps extend within the first pair of receiving apertures and the second pair of receiving apertures, respectively, so as to interlock each of the first and second top end flaps with both of the first and second top side flaps.

Embodiment 6

The box of one of Embodiments 1 through 5, wherein, in the intermediate and fully closed configurations, each of the first, second, third, and fourth handle apertures is elongate along a second direction that is substantially perpendicular to the first direction, and the third and fourth handle apertures are configured to cause the first and second top end flaps to bend about respective crease lines extending along the second direction and intersecting the third and fourth handle apertures, respectively.

Embodiment 7

The box of any one of Embodiments 4 through 6, wherein each of the receiving apertures is substantially L-shaped and has a base portion and an extension portion oriented substantially perpendicular to the base portion, and each protrusion of the pair of protrusions is configured to enter the associated receiving aperture through the base portion.

Embodiment 8

The box of any one of Embodiment 4 through 7, wherein the pair of protrusions of each of the first and second top end flaps have tapered inner edges that taper toward each other such that, when in the fully closed configuration, the tapered inner edges underlie respective portions of the first and second top side flaps adjacent the associated extension portions of the receiving apertures.

Embodiment 9

The box of any one of Embodiments 4 through 8, wherein the first and second top side flaps are sized such that, in the fully closed configuration, the first and second top side flaps overlap one another along a second direction that is substantially perpendicular to the first direction.

Embodiment 10

The box of any one of Embodiments 4 through 9, wherein the first and second top side flaps define respective first and second substantially V-shaped notches, and, in the fully closed configuration, the first and second substantially V-shaped notches interlock with one another such that the first and second top side flaps are interlocked with one another.

Embodiment 11

A method of preparing a container, comprising: manipulating the container from an open configuration toward a fully closed configuration, wherein, in the open configuration, first and second top end flaps are folded outwardly with respect to first and second endwalls, respectively, such that 1) a first pair of handle apertures that are defined respectively in the first endwall and the first top end flap are aligned with each other along a first direction, and 2) a second pair of handle apertures that are defined respectively in the second endwall and the second top end flap are aligned with each other along the first direction, wherein the manipulating step comprises: folding first and second top side flaps inwardly towards one another along a second direction until the first and second top side flaps are substantially perpendicular to the first and second endwalls and to first and second sidewalls of the container, thereby at least partially covering a top opening of the container, wherein the first and second top side flaps extend respectively from the first and second sidewalls, and the second direction is substantially perpendicular to the first direction; and folding the pair of top end flaps inwardly towards one another until the first and second top end flaps are substantially parallel with the first and second top side flaps, wherein the first and second top side flaps underlie the respective ones of the first and second pairs of handle apertures that are defined in the first and second top end flaps.

Embodiment 12

The method of Embodiment 11, wherein: in the open configuration, the first and second top end flaps are locked in respective positions whereby the first and second top end flaps are doubled over the first and second endwalls, respectively; and the method further comprises, prior to the second folding step, unlocking the pair of top end flaps from their respective doubled over positions.

Embodiment 13

The method of Embodiment 11 or Embodiment 12, wherein the unlocking step comprises: breaking a first frangible tab connecting the first top end flap with the second top side flap; and breaking a second frangible tab connecting the second top end flap with the first top side flap.

Embodiment 14

The method of any one of Embodiments 11 through 13, wherein, in the open configuration, 1) the first frangible tab extends from the first top end flap to a connecting tab, and 2) the connecting tab is affixed at least to the second top side flap.

Embodiment 15

The method of any one of Embodiments 11 through 14, wherein the second folding step comprises: inserting at least one first protrusion defined by the first top end flap into at least one first receiving aperture defined by one of the first and second top side flaps; and inserting at least one second protrusion defined by the second top end flap into at least one second receiving aperture defined by one of the first and second top side flaps.

Embodiment 16

The method of Embodiment 15, wherein each of the at least one first receiving aperture and the at least one second receiving aperture is substantially L-shaped and has a base portion and an extension portion that is substantially perpendicular to the base portion.

Embodiment 17

The method of Embodiment 16, wherein: the first inserting step comprises advancing the at least one first protrusion through the base portion and thereafter, along the first direction, along the extension portion of the at least first one receiving aperture; and the second inserting step comprises advancing the at least one second protrusion through the base portion and thereafter, along the first direction, along the extension portion of the at least one second receiving aperture.

Embodiment 18

The method of any one of Embodiments 11 through 17, wherein, the second folding step comprises, prior to the first and second inserting steps, folding each of the first and second end flaps about respective crease lines that extend along the second direction and intersect the respective handle apertures defined in the first and second top end flaps.

Embodiment 19

A method of sorting items, comprising: performing the method of any one of Embodiments 11 through 18, wherein, in the open configuration, the container has a closed bottom; and inducting one or more items into the container while the container is in the open configuration.

Embodiment 20

The method of Embodiment 19, further comprising, after the second folding step, conveying the container in the fully closed configuration on a mechanical conveyor to a staging location within an order fulfillment center.

It should be noted that the illustrations and descriptions of the embodiments shown in the figures are for exemplary purposes only, and should not be construed limiting the disclosure. One skilled in the art will appreciate that the present disclosure contemplates various embodiments. Additionally, it should be understood that the concepts described above in connection with the respective above-described embodiments may be employed alone or in combination with any of the other embodiments described above. It should further be appreciated that the various alternative embodiments described above with respect to one illustrated embodiment can apply to all embodiments as described herein, unless otherwise indicated. Also, the present invention is not intended to be limited by any description of drawbacks or problems with any prior art device.

Unless explicitly stated otherwise, each numerical value and range should be interpreted as being approximate as if the word "about" or "approximately" preceded the value or range.

It should be understood that the steps of exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

What is claimed is:

1. A box for containing one or more items, the box being foldable from a substantially flat initial configuration into an open, intermediate configuration and further into a fully closed configuration, the box comprising:

first and second sidewalls opposite one another;

first and second endwalls opposite one another, the first endwall defining a first handle aperture, the second endwall defining a second handle aperture;

first and second top end flaps extending respectively from the first and second endwalls, the first top end flap defining a third handle aperture, the second top end flap defining a fourth handle aperture; and first and second top side flaps extending respectively from the first and second sidewalls, wherein, in the intermediate configuration, 1) the first and second top end flaps are folded so as to be doubled over, and parallel with, the first and second endwalls, respectively, 2) the first and third handle apertures are aligned with each other along a first direction so as to be gripped by a hand, and 3) the second and fourth handle apertures are aligned with each along the first direction so as to be gripped by another hand, and wherein, in the fully closed configuration, 1) the first and second top end flaps are folded so as to be substantially perpendicular to the first and second endwalls, respectively, 2) the first and second top side flaps are folded so as to be substantially perpendicular to the first and second sidewalls, respectively, and to underlie both of the third and fourth handle apertures, and 3) the first and second top end flaps and the first and second top side flaps collectively interlock with each other.

2. The box of claim 1, further comprising:

a pair of bottom end flaps extending respectively from the first and second endwalls opposite the first and second top end flaps; and a pair of bottom side flaps extending respectively from the first and second sidewalls opposite the first and second top side flaps, wherein, in both of the intermediate and fully closed configurations, 1) the first and second bottom side flaps are folded so as to be substantially perpendicular to the first and second sidewalls, respectively, and 2) the first and second bottom end flaps are folded so as to be substantially perpendicular to the first and second endwalls.

3. The box of claim 1, further comprising:

a first hinge tab located within one of the first and third handle apertures when the box is in the initial configuration, wherein the first hinge tab is foldable so as to vacate the one of the first and third handle apertures; and a second hinge tab located within one of the second and fourth handle apertures when the box is in the initial configuration, wherein the second hinge tab is foldable so as to vacate the one of the second and fourth handle apertures.

4. The box of claim 1, wherein the first top end flap defines a first pair of protrusions, the second top end flap defines a second pair of protrusions, the first and second top side flaps collectively define a first pair of receiving apertures, and the first and second top side flaps collectively define a second pair of receiving apertures.

5. The box of claim 4, wherein, in the fully closed configuration, the first pair of protrusions of the first top end flap and the second pair of protrusions of the second top end flaps extend within the first pair of receiving apertures and the second pair of receiving apertures, respectively, so as to interlock each of the first and second top end flaps with both of the first and second top side flaps.

6. The box of claim 5, wherein, in the intermediate and fully closed configurations, each of the first, second, third, and fourth handle apertures is elongate along a second direction that is substantially perpendicular to the first direction, and the third and fourth handle apertures are configured to cause the first and second top end flaps to bend about respective crease lines extending along the second direction and intersecting the third and fourth handle apertures, respectively.

7. The box of claim 5, wherein each of the receiving apertures is substantially L-shaped and has a base portion and an extension portion oriented substantially perpendicular to the base portion, and each protrusion of the first and second pairs of protrusions is configured to enter the associated receiving aperture through the base portion.

8. The box of claim 7, wherein the first and second pairs of protrusions each have tapered inner edges that taper toward each other such that, when in the fully closed configuration, the tapered inner edges underlie respective portions of the first and second top side flaps adjacent the associated extension portions of the receiving apertures.

9. The box of claim 8, wherein the first and second top side flaps are sized such that, in the fully closed configuration, the first and second top side flaps overlap one another along a second direction that is substantially perpendicular to the first direction.

10. The box of claim 9, wherein the first and second top side flaps define respective first and second substantially V-shaped notches, and, in the fully closed configuration, the first and second substantially V-shaped notches interlock with one another such that the first and second top side flaps are interlocked with one another.

11. A method of preparing a container, comprising:

manipulating the container from an open configuration toward a fully closed configuration, wherein, in the open configuration, first and second top end flaps are folded outwardly with respect to first and second endwalls, respectively, such that 1) a first pair of handle apertures that are defined respectively in the first endwall and the first top end flap are aligned with each other along a first direction, and 2) a second pair of handle apertures that are defined respectively in the second endwall and the second top end flap are aligned with each other along the first direction, wherein the manipulating step comprises:

folding first and second top side flaps inwardly towards one another along a second direction until the first and second top side flaps are substantially perpendicular to the first and second endwalls and to first and second sidewalls of the container, thereby at least partially covering a top opening of the container, wherein the first and second top side flaps extend respectively from the first and second sidewalls, and the second direction is substantially perpendicular to the first direction; and folding the first and second top end flaps inwardly towards one another until the first and second top end flaps are substantially parallel with the first and second top side flaps, wherein the first and second top side flaps underlie the respective ones of the first and second pairs of handle apertures that are defined in the first and second top end flaps.

12. The method of claim 11, wherein:

in the open configuration, the first and second top end flaps are locked in respective positions whereby the first and second top end flaps are doubled over the first and second endwalls, respectively; and the method further comprises, prior to the second folding step, unlocking the first and second top end flaps from their respective doubled over positions.

13. The method of claim 12, wherein the unlocking step comprises:

breaking a first frangible tab connecting the first top end flap with the second top side flap; and breaking a second frangible tab connecting the second top end flap with the first top side flap.

14. The method of claim 13, wherein, in the open configuration, 1) the first frangible tab extends from the first top end flap to a connecting tab, and 2) the connecting tab is affixed at least to the second top side flap.

15. The method of claim 11, wherein the second folding step comprises:

inserting at least one first protrusion defined by the first top end flap into at least one first receiving aperture defined by one of the first and second top side flaps; and inserting at least one second protrusion defined by the second top end flap into at least one second receiving aperture defined by one of the first and second top side flaps.

16. The method of claim 15, wherein each of the at least one first receiving aperture and the at least one second receiving aperture is substantially L-shaped and has a base portion and an extension portion that is substantially perpendicular to the base portion.

17. The method of claim 16, wherein:

the first inserting step comprises advancing the at least one first protrusion through the base portion and thereafter, along the first direction, along the extension portion of the at least first one receiving aperture; and the second inserting step comprises advancing the at least one second protrusion through the base portion and thereafter, along the first direction, along the extension portion of the at least one second receiving aperture.

18. The method of claim 15, wherein, the second folding step comprises, prior to the first and second inserting steps, folding each of the first and second top end flaps about respective crease lines that extend along the second direction and intersect the respective handle apertures defined in the first and second top end flaps.

19. A method of sorting items, comprising:

the method of claim 11, wherein, in the open configuration, the container has a closed bottom; and inducting one or more items into the container while the container is in the open configuration.

20. The method of claim 19, further comprising, after the second folding step, conveying the container in the fully closed configuration on a mechanical conveyor to a staging location within an order fulfillment center.

* * * * *